US006478393B2

(12) United States Patent
Kim et al.

(10) Patent No.: US 6,478,393 B2
(45) Date of Patent: Nov. 12, 2002

(54) SLIDING DEVICE FOR A STORAGE CASE

(75) Inventors: Yong-Myoung Kim, Suwon; Jeong-Man Nam, Kwangju, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 38 days.

(21) Appl. No.: 09/731,897

(22) Filed: Dec. 8, 2000

(65) Prior Publication Data

US 2002/0033657 A1 Mar. 21, 2002

(30) Foreign Application Priority Data

Aug. 28, 2000 (KR) ..... 00-50069

(51) Int. Cl.[7] ..... A47B 88/04

(52) U.S. Cl. ..... 312/334.12; 312/334.7; 312/330.1; 384/19

(58) Field of Search ..... 312/330.1, 334.1, 312/334.7, 334.8, 334.9, 334.12, 334.16, 334.18, 333, 402, 404; 384/19

(56) References Cited

U.S. PATENT DOCUMENTS 533,622 A * 2/1895 Turner ..... 312/334.12

4,445,726 A * 5/1984 Rock et al. ..... 384/19

FOREIGN PATENT DOCUMENTS

| | | | | |
|---|---|---|---|---|
| CA | 582516 | * | 9/1959 | ..... 312/334.12 |
| JP | 07-043064 | | 2/1995 | |
| JP | 11-118336 | | 4/1999 | |

* cited by examiner

*Primary Examiner*—James O. Hansen
(74) *Attorney, Agent, or Firm*—Larson & Taylor, PLC

(57) ABSTRACT

A sliding device for a storage case is provided which is durable and provides a smooth sliding motion even in environments, such as those encountered in a refrigerator, wherein the storage case is subjected to humid, cold (below the freezing point) conditions. The sliding device comprises a fixed rail fixedly mounted to an inner side surface of the storage case and having a roller coupling portion in which a first set of rollers are rollably received; a movable rail fixedly mounted to an outer side surface of the storage container and having a roller coupling portion in which a set of second rollers are rollably received; and a middle rail which is slidably mounted between the fixed rail and the movable rail so as to provide a coupling relationship therebetween which guides the rolling motion of the first and second rollers. The fixed rail, the movable rail and the middle rail, as well as the rollers, are made of an injection molded plastic.

9 Claims, 7 Drawing Sheets

SLIDING DEVICE FOR A STORAGE CASE

BACKGROUND OF THE INVENTION

1. Field of the Invention

The present invention relates to a sliding device for a storage case, and, more particularly, to a sliding device which can slide smoothly when mounted inside a storage case, such as a refrigerator, in a humid and cold (freezing) environment.

2. Description of Related Art

To promote smooth movement backward and forward of a heavy storage container containing a storage case with goods therein, sliding devices are provided on both outer side surfaces of the storage container and both inner side surfaces of the storage case.

Such sliding devices typically include a fixed rail, a movable rail, a plurality of balls, and a supporting means for the balls mounted on an inner side surface of the storage case. The fixed rail extends over its full length in the sliding direction of the storage container. The movable rail is mounted to an outer side surface of the storage container in alignment with the fixed rail and slides along the fixed rail. The plurality of balls are located between the fixed rail and the movable rail.

The fixed rail and the movable rail are made from roll formed metal plates. The rails are formed with concave guiding grooves for receiving the balls therein. The balls roll along the guiding grooves while closely contacting the grooves.

When this type of sliding device is used in a storage case for storing foods, the metal rails and balls may oxidize, i.e., rust, since the component parts of the sliding device are exposed to moisture. Thus, the rolling motion of the balls is eventually impaired and it becomes troublesome to open or shut the storage container. That is, if the guiding grooves and the small rolling balls become rusty, the sliding motion of the storage container is impaired and the life of the sliding device is shortened.

Further, when this type of sliding device is used in a storage case for a refrigerator or the like which is kept humid and cold, i.e., at a temperature below the freezing point, moisture is condensed and frozen on the rails or the balls, thereby impeding the sliding motion of the storage container.

Finally, because the fixed rail and the movable rail are made by roll formed metal plates, the manufacturing cost of these rails is high.

SUMMARY OF THE INVENTION

The present invention concerns a sliding device for a storage case which is constructed to solve the problems discussed above.

It is an object of the present invention to provide a sliding device for a storage case which does not rust but which provides a smooth sliding motion even when the storage case is kept humid and cold (below the freezing point) and granular ice is formed on rails.

It is another object of the present invention to provide a sliding device for a storage case which is durable and can be manufactured more easily and cheaply than conventional devices used for the same purposes.

In accordance with the invention, a sliding device is provided for providing sliding backward and forward movement of a drawer-type storage container relative to a storage case, the storage container being slidably mounted inside the storage case, and the sliding device comprising: a first plurality of rollers; a second plurality of rollers; a fixed rail fixedly mounted to an inner side surface of the storage case and including a roller coupling portion rollably receiving the first plurality of rollers; a movable rail fixedly mounted to an outer side surface of the storage container and including a roller coupling portion rollably received in the second plurality of rollers; and a middle rail slidably mounted between the fixed rail and the movable rail for providing a coupling relationship therebetween and for guiding the rolling motion of the first and second plurality of rollers, such that the movable rail and the storage container slide together by means of a rolling motion of the second plurality of rollers along the middle rail, and the middle rail slides along the fixed rail by means of a rolling motion of the first plurality of rollers.

Preferably, the middle rail further comprises an upper rail portion, including an upper channel for receiving the roller coupling portion of the movable rail therein and for guiding the sliding motion of the movable rail, a lower rail portion including a lower channel for receiving the roller coupling portion of the fixed rail therein and for guiding the sliding motion of the middle rail, and a partition rail portion integrally connecting the upper rail portion and the lower rail portion while partitioning the upper channel from the lower channel, and the fixed rail includes guiding space receiving the upper rail portion and the movable rail includes a guiding space for receiving the lower rail portion.

Advantageously, the upper rail portion of the middle rail opens toward the roller coupling portion of the movable rail, and the lower rail portion of the middle rail opens toward the roller coupling portion of the fixed rail.

Preferably, first movement restricting means are located between the fixed rail and the middle rail for restricting the movement of the middle rail, and second movement restriction means are located between the middle rail and the movable rail for restricting the movement of the movable rail.

Advantageously, the first and second movement restricting means each include hooking members and respective openings for receiving the hooking members therein.

Preferably, the hooking members protrude upwardly from the upper end surface of the middle rail and downwardly from the lower end surface of the middle rail, and the openings extend longitudinally of the fixed rail and at the movable rail, respectively.

Advantageously, a plurality of slots are formed in the roller coupling portions of the fixed rail and movable rail, respectively, such that the first plurality of rollers and the second plurality of rollers extend through the slots and undergo rolling motion in contact with the corresponding partition rail portion.

Preferably, the partition rail portion includes guiding grooves extending of the partition rail portion for guiding the rolling motion of the first and second plurality of rollers.

Advantageously, the invention further comprises a first roller supporting member within which the first plurality of rollers are disposed in series and a second roller supporting member within which the second plurality of rollers are disposed in series, the first roller supporting member being disposed in the roller coupling portion of the fixed rail and the second roller supporting member being disposed in the roller coupling portion of the movable rail.

Preferably, the movable rail is comprised of an injection molded plastic, the fixed rail is comprised of an injection molded plastic, the middle rail is comprised of an injection molded plastic, and the rollers are comprised of an injection molded plastic.

Further features and advantages of the present invention will be set forth in, or apparent from, the detailed description of preferred embodiments thereof which follows.

BRIEF DESCRIPTION OF THE DRAWINGS

The accompanying drawings, which are incorporated in and constitute a part of the specification, illustrate a preferred embodiment of the invention, and, together with the description which follows, serve to explain the principles of the invention.

DETAILED DESCRIPTION OF THE PREFERRED EMBODIMENTS

A preferred embodiment of the present invention will now be described in detail with reference to the accompanying drawings.

Figure 1:
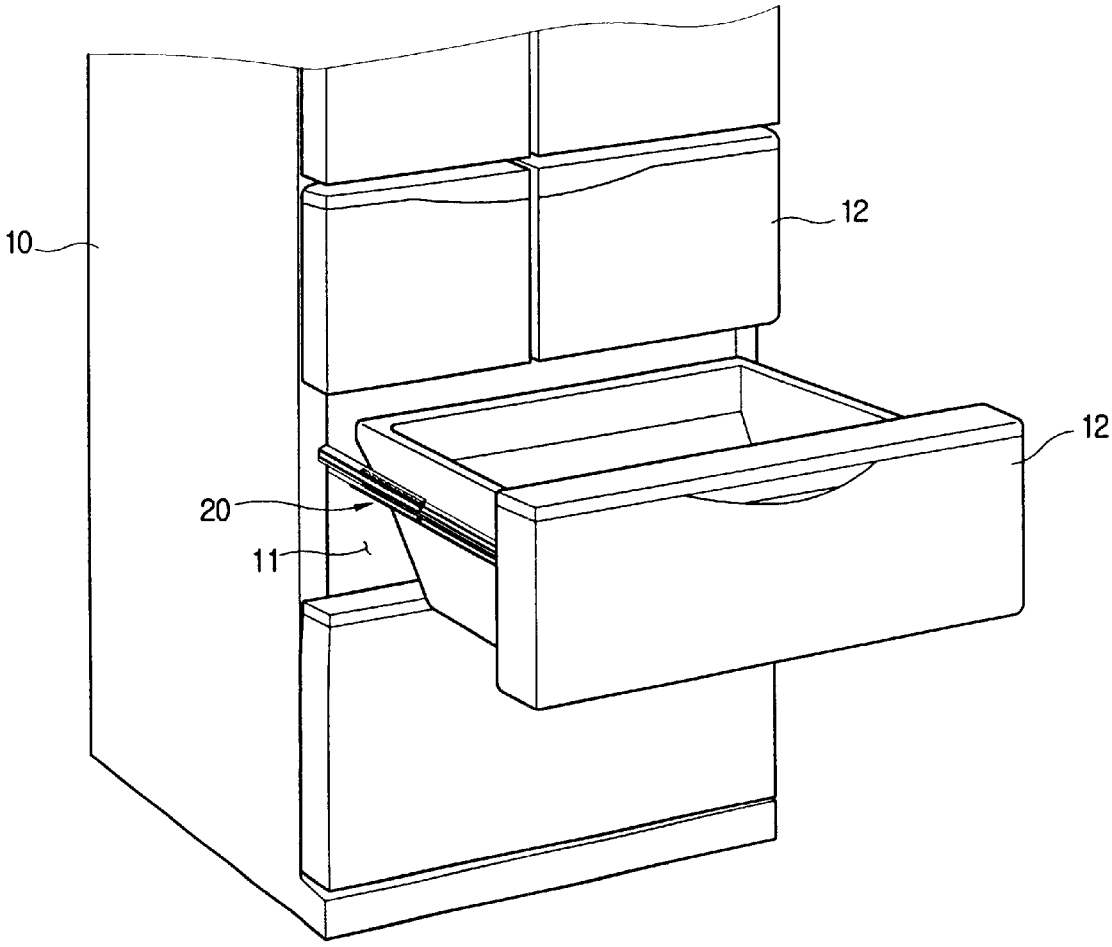
FIG. 1 is a perspective view of a refrigerator containing a sliding device for a storage case in accordance with a preferred embodiment of the present invention.

Referring to FIG. 1, a refrigerator for keeping foods in cold storage is shown which comprises an insulated main body 10 and a storage chamber 11. The storage chamber 11 is open at its front portion. Slidably mounted inside the storage chamber 11 are one or more drawer-type storage containers 12 which are typically filled with food. This slidably mounting is provided by a pair of sliding devices; one sliding device, is denoted 20 and the other corresponding sliding device is hidden from view on the opposite side of the storage container 12. The two sliding devices are collectively referred to as sliding devices 20 hereinbelow. The sliding devices 20 enable the storage containers 12 to slide backwardly and forwardly and, as explained below, are mounted on the storage chamber 11 and the corresponding storage container 12.

Figure 2:
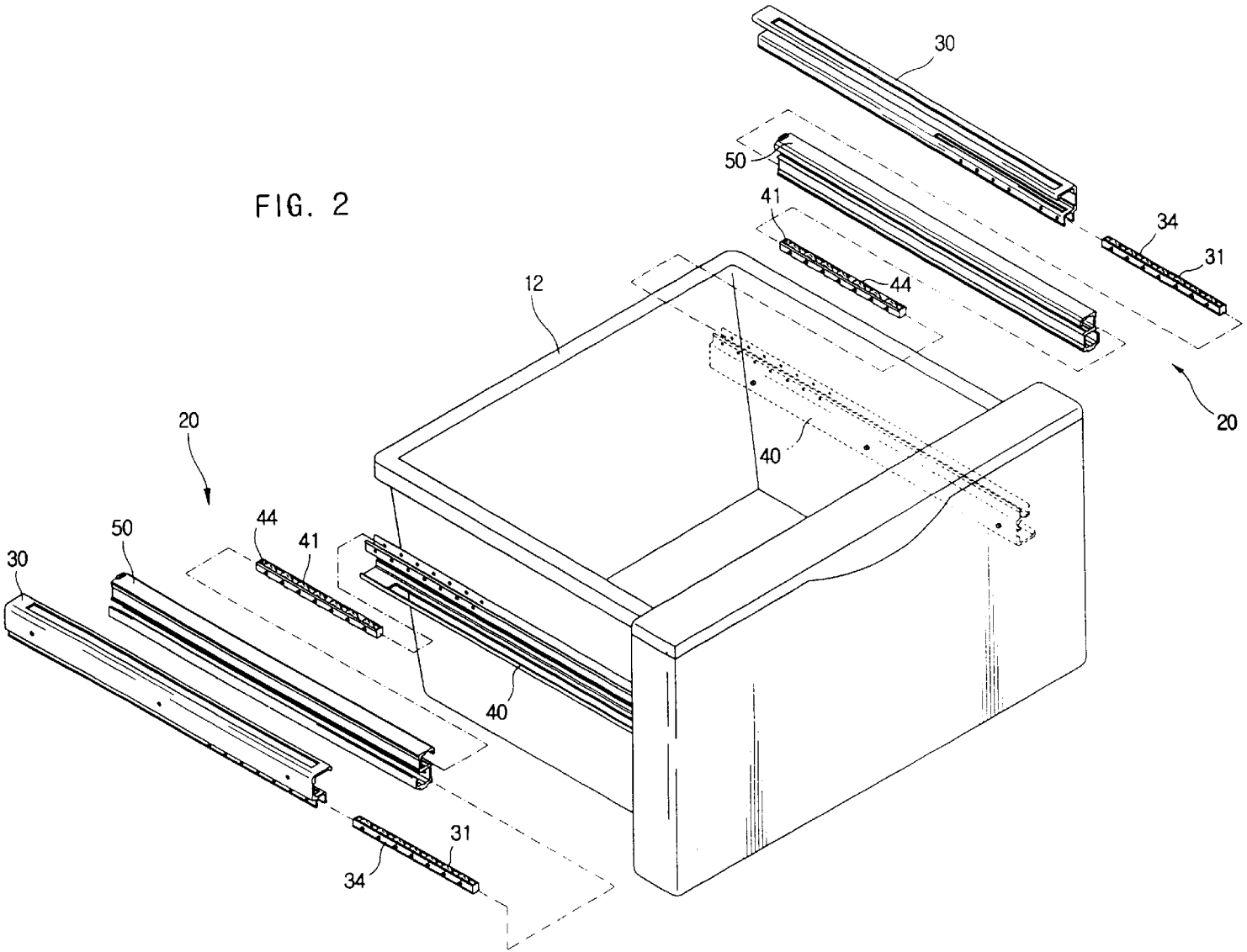
FIG. 2 is an exploded perspective view of a sliding device for the storage case.

As shown in FIG. 2, each sliding device 20 comprises a fixed rail 30 which is fixedly mounted to an inner side surface of the storage chamber 11 of the refrigerator body 10. The fixed rail 30 extends axially outwardly from this surface in the direction of a sliding motion of the storage container 12. A movable rail 40 is mounted on an outer side surface of the storage container 12 so as to slide along the fixed rail 30. A middle or intermediate rail 50 is slidably mounted between the fixed rail 30 and the movable rail 40 and provides coupling shown between the fixed rail 30 and the movable rail 40. Because each of the pair of sliding devices 20 mounted on opposite sides of the storage container 12 is of the same construction, only one sliding device will be described hereinafter in detail.

Figure 3:
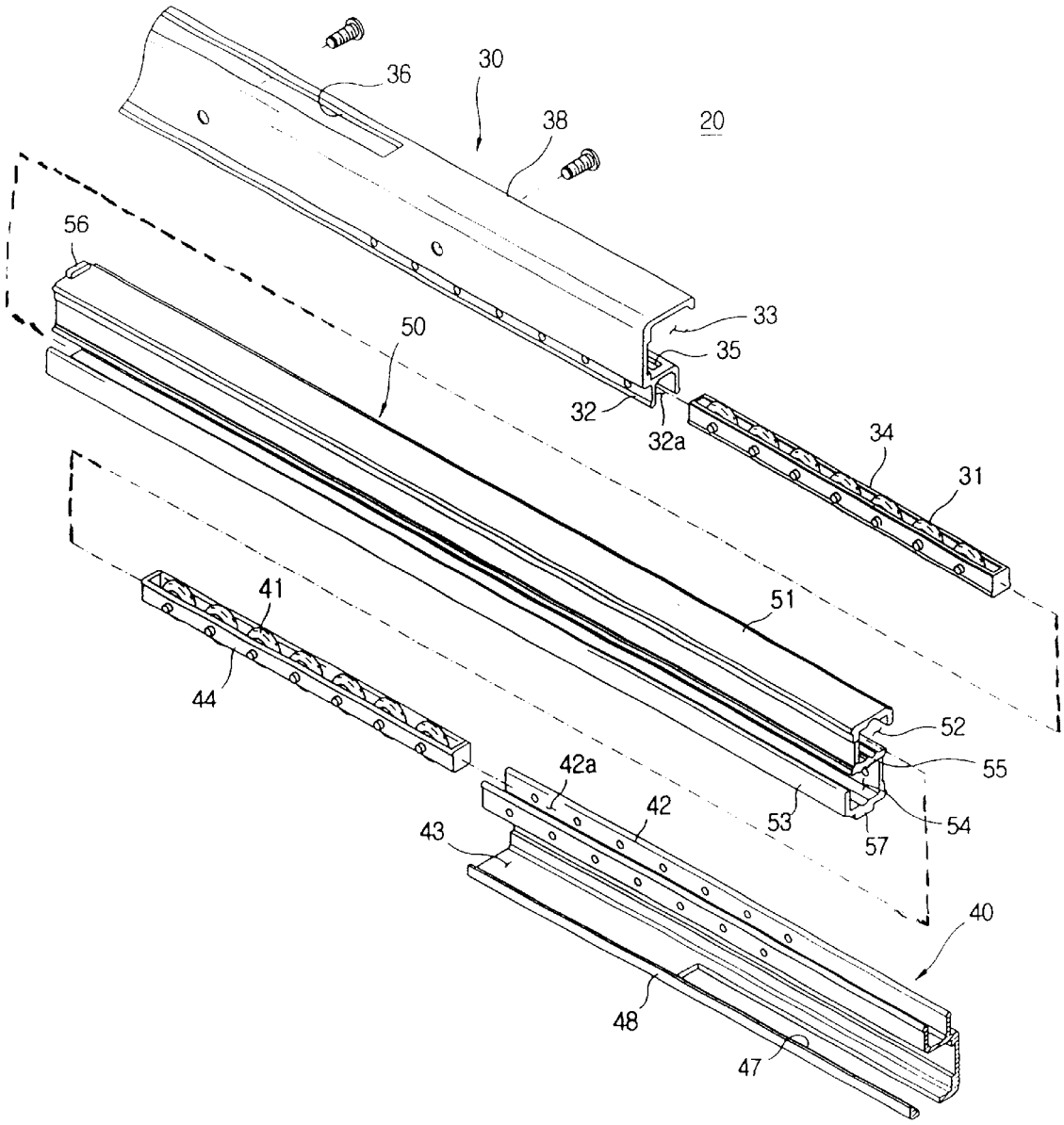
FIG. 3 is an exploded perspective view of detailed structures of respective component parts of the embodiment of the sliding device as shown in FIG. 2.
Figure 4:
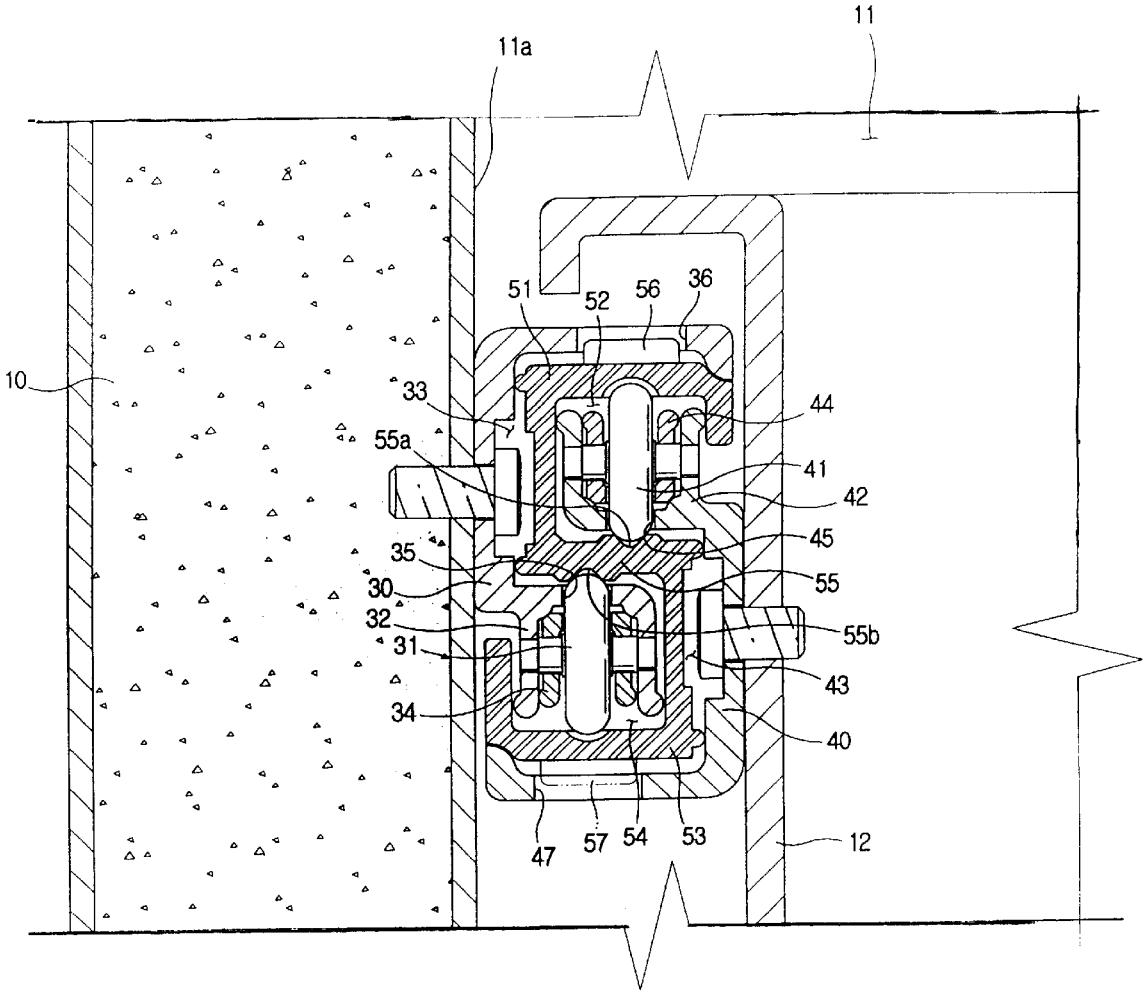
FIG. 4 is a cross-sectional view of component parts of the embodiment of the sliding device shown in FIG. 3 in an assembled state.

Referring to FIGS. 3 and 4, the fixed rail 30, which is made of an injection molded plastic, includes a rail receiving portion 38 which has a flattened C-shaped traverse cross section. The rail receiving portion 38 includes a guiding space 33 and a roller coupling portion 32. The roller coupling portion 32 extends downward from the rail receiving portion 38 to form a receiving space 32*a* into which a first plurality of rollers 31 are received. An upper rail portion 51 of the middle rail 50, which is described hereinbelow, is slidably received in the guiding space 33 of the rail receiving portion 38. The rollers 31 are disposed in series in a roller supporting member 34. The roller supporting member 34 is of a predetermined length and is open at its upper and lower portions. The roller supporting member 34 receiving the rollers 31 therein is received in the receiving space 32*a* of the roller coupling portion 32.

The movable rail 40 is of the same construction as the fixed rail 30, and is mounted on a side surface of the storage container 12 so as to slide with the storage container 12. The movable rail 40 includes a roller coupling portion 42 at an upper portion thereof, and a rail receiving portion 48 at a lower portion thereof. Accordingly, the roller coupling portion 42 and the rail receiving portion 48 of the movable rail 40 are disposed in a reversed orientation with respect to the corresponding portions 32 and 38 of the fixed rail 30.

A second plurality of rollers 41 is disposed in series in a roller supporting member 44. The coupling structure thereof corresponds to the coupling structure of the rollers 31. The roller supporting member 44, with the second rollers 41 received therein, is inserted into, i.e., received in, a receiving space 42*a* of the roller coupling portion 42 of the movable rail 40.

The first and second rollers 31 and 41, which are respectively mounted on the fixed rail 30 and the movable rail 40, as well as the roller supporting members 34 and 44, are made of an injection molded plastic. This prevents sliding device 20 from becoming rusty when used in the humid storage chamber 11 of a refrigerator or the like. Accordingly, the storage container 12 slides smoothly, and, moreover, the sliding device 20 can be easily manufactured.

The middle rail 50 has an S-shaped transverse cross section and is coupled to the fixed rail 30 and movable rail 40. The middle rail 50 includes an upper rail portion 51 formed with an upper channel 52 for receiving the roller coupling portion 42 of the movable rail 40, and for guiding the sliding motion of the movable rail 40. The middle rail 50 also includes a lower rail portion 53 formed with a lower channel 54 for receiving the roller coupling portion 32 of the fixed rail 30 therein, and for enabling the middle rail 50 to slide by virtue of the rolling motion of the first rollers 31 of the fixed rail 30. Additionally, a partition rail portion 55 connects the upper rail portion 51 with the lower rail portion 53 and forms a partition between the upper channel 52 and the lower channel 54. The partition rail portion 55 is formed between the upper and lower rail portions 51 and 53. In other words, the upper channel 52 and the lower channel 54 are respectively disposed above and below the partition rail portion 55. The middle rail 50 is also made of an injection molded plastic.

After the fixed rail 30 and the movable rail 40 are coupled to the middle rail 50, the upper rail portion 51 of the middle rail 50 is slidably inserted into the guiding space 33 of the rail receiving portion 38 of the fixed rail 30, as shown in FIG. 4. Further, the lower rail portion 53 of the middle rail 50 is slidably inserted into the guiding space 43 of the rail receiving portion 48 of the movable rail 40. In addition, the roller coupling portion 32 of the fixed rail 30 is disposed in the lower channel 54 of the middle rail 50, and the roller coupling portion 42 of the movable rail 40 is slidably disposed in the upper channel 52.

Slots 35 and 45, through which the rollers 31 and 41 pass, are formed lengthwise at the corresponding roller coupling portions 32 and 42 of the fixed rail 30 and the movable rail 40, respectively so that the first and second rollers 31 and 41 can roll when in contact with the partition rail portion 55 of the middle rail 50 when the rails 30, 40 and 50 are assembled as aforementioned. Stated differently, the first and second rollers 31 and 41 protrude toward the respective guiding spaces 33 and 43 through the slots 35 and 45 formed at the fixed and movable rails 30 and 40, when the middle rail 50 is coupled to the fixed and movable rails 30 and 40, and thus the first and second rollers 31 and 41 are disposed in contact with the partition rail portion 55 of the middle rail 50. Guiding grooves 55*a* and 55*b* for guiding the rolling motion of the first and second rollers 31 and 41 are formed lengthwise at the upper and lower surfaces of the partition rail portion 55, respectively.

Each sliding device 20 further includes a first movement restricting means between the fixed rail 30 and the middle rail 50 and a second movement restricting means between the middle rail 50 and the movable rail 40 for restricting the movement of the middle rail 50 and for restricting the movement of the movable rail 40, respectively. The first means, i.e., the means for restricting the movement of the middle rail 50, includes an upper hooking member or hook 56 which protrudes upward from upper rear end portion of the upper rail portion 51 of the middle rail 50, and protrudes from an upper opening 36. The upper opening 36 extends lengthwise for a predetermined distance in an upper surface of the fixed rail 30. Accordingly, as the middle rail 50 slides backwardly and forwardly, the upper hooking member 56 engages the front end of the upper opening 36, thereby stopping movement of the middle rail 50. The second means, i.e., the means for restricting the range of motion or moving distance of the movable rail 40 includes a lower hooking member 57 which protrudes downwardly from a lower front end portion of the lower rail portion 53 of the middle rail 50, and protrudes from a lower opening 47. The lower opening 47 extends lengthwise for a predetermined length in a lower surface of the movable rail 40. Accordingly, as the moving rail 40 slides backwardly and forwardly, the lower hooking member 57 engages the rear end of the lower opening 47, thereby stopping movement of the movable rail 40.

Figure 5:
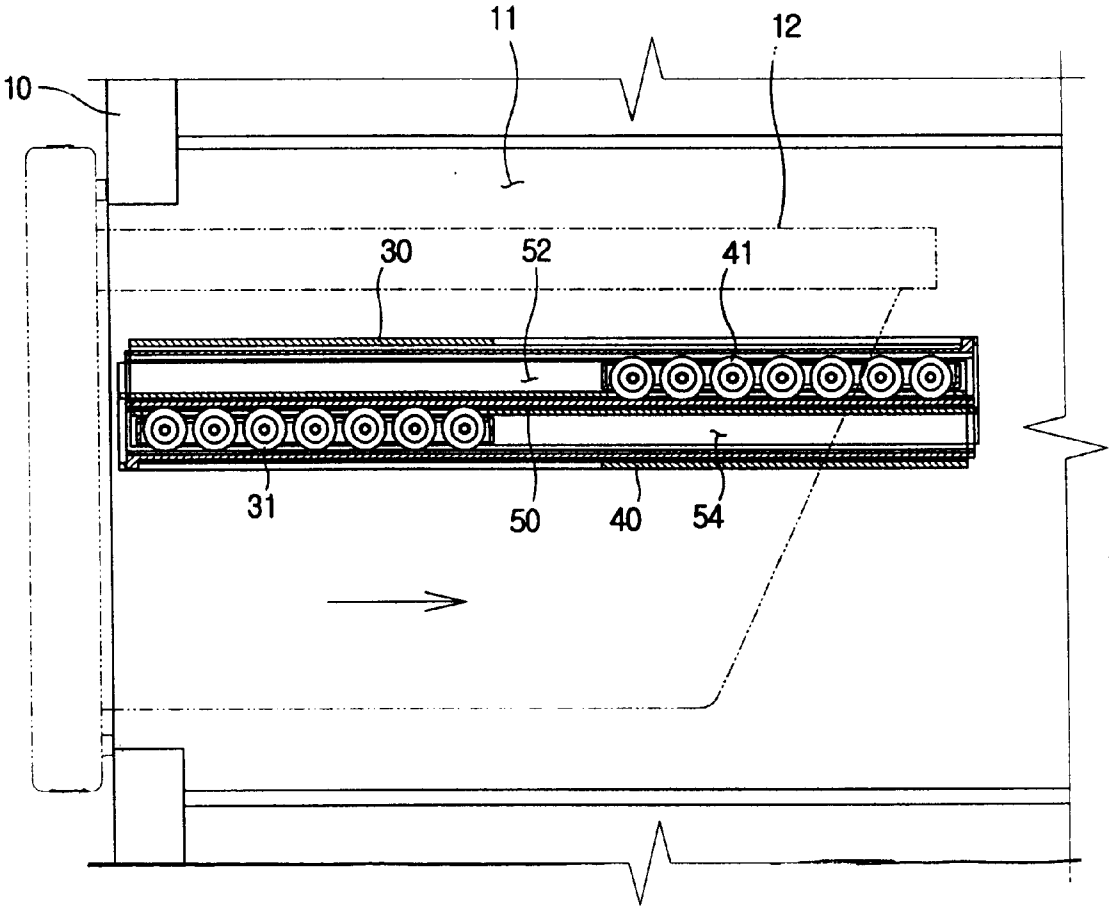
FIG. 5 is a side-sectional view of an embodiment of the sliding device wherein the storage container is in a closed position.
Figure 6:
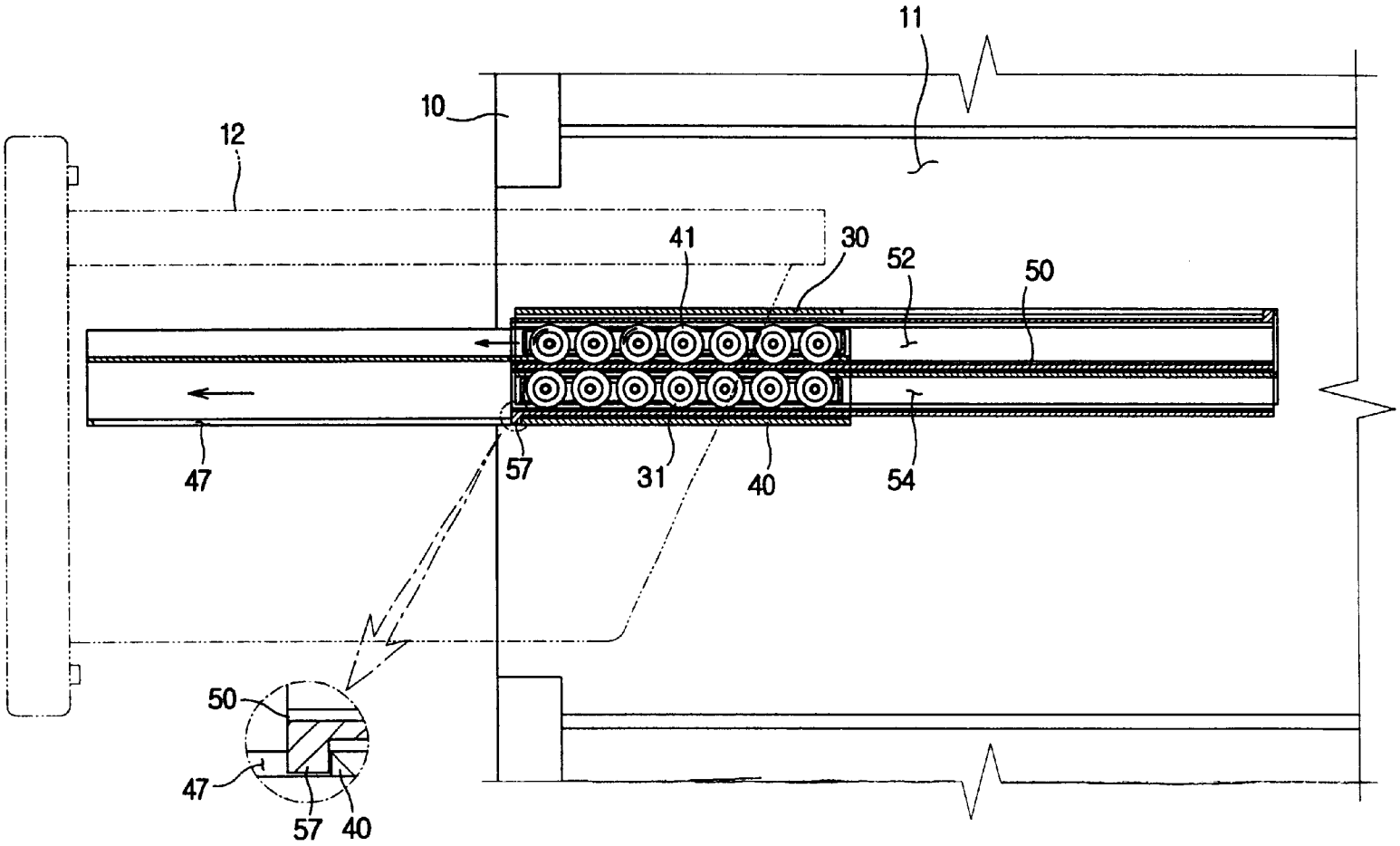
FIG. 6 is a side-sectional view of an embodiment of the sliding device wherein the storage container is in a half-closed position.

In operation, when the rails 30, 40 and 50 are assembled, i.e., coupled together as shown in FIG. 4, the storage container 12 is slidably mounted in the storage chamber 11 and the rails 30, 40 and 50 are located substantially one over another as shown in FIG. 5. The first rollers 31 are received in the lower channel 54 of the middle rail 50 and are supported by the roller coupling portion 32 (FIG. 4) of the fixed rail 30. The first rollers 31 are located at a frontal open portion of the storage chamber 11. The second rollers 41 are received in the upper channel 52 of the middle rail 50 and are supported by the roller coupling portion 42 (FIG. 4) of the moving rail 40. As illustrated, the second rollers 41 are located at a rear closed portion of the storage chamber 11. When the storage container 12 is pulled forwardly to open the same, the movable rail 40 which is mounted on the side surface of the storage container 12, is moved forward. Consequently, the second rollers 41 of the movable rail 40 roll along the guiding groove 55*a* (FIG. 4) formed at the lower surface of the upper channel 52 of the middle rail 50. Accordingly, movable rail 40 is moved forward with the storage container 12. As shown in FIG. 6, when the storage container 12 is in a half opened position, the lower hooking member 57 of the middle rail 50 is located adjacent to a rear portion of the lower opening 47 of the movable rail 40. The second rollers 41 move toward a front portion of the upper channel 52 which is disposed above the first rollers 31. When the storage container 12 is pulled forward, the lower hooking member 57 of the middle rail 50 engages the rear end of the lower opening 47 of the movable rail 40 thereby stopping further movement of the movable rail 40.

If, at this stage, the storage container 12 is pulled forwardly, the lower hooking member 57, with which the rear end of the lower opening 47 is engaged, is also pulled forwardly. Accordingly, the middle rail 50 moves forward with the storage container 12 while the first rollers 31 roll without moving.

Figure 7:
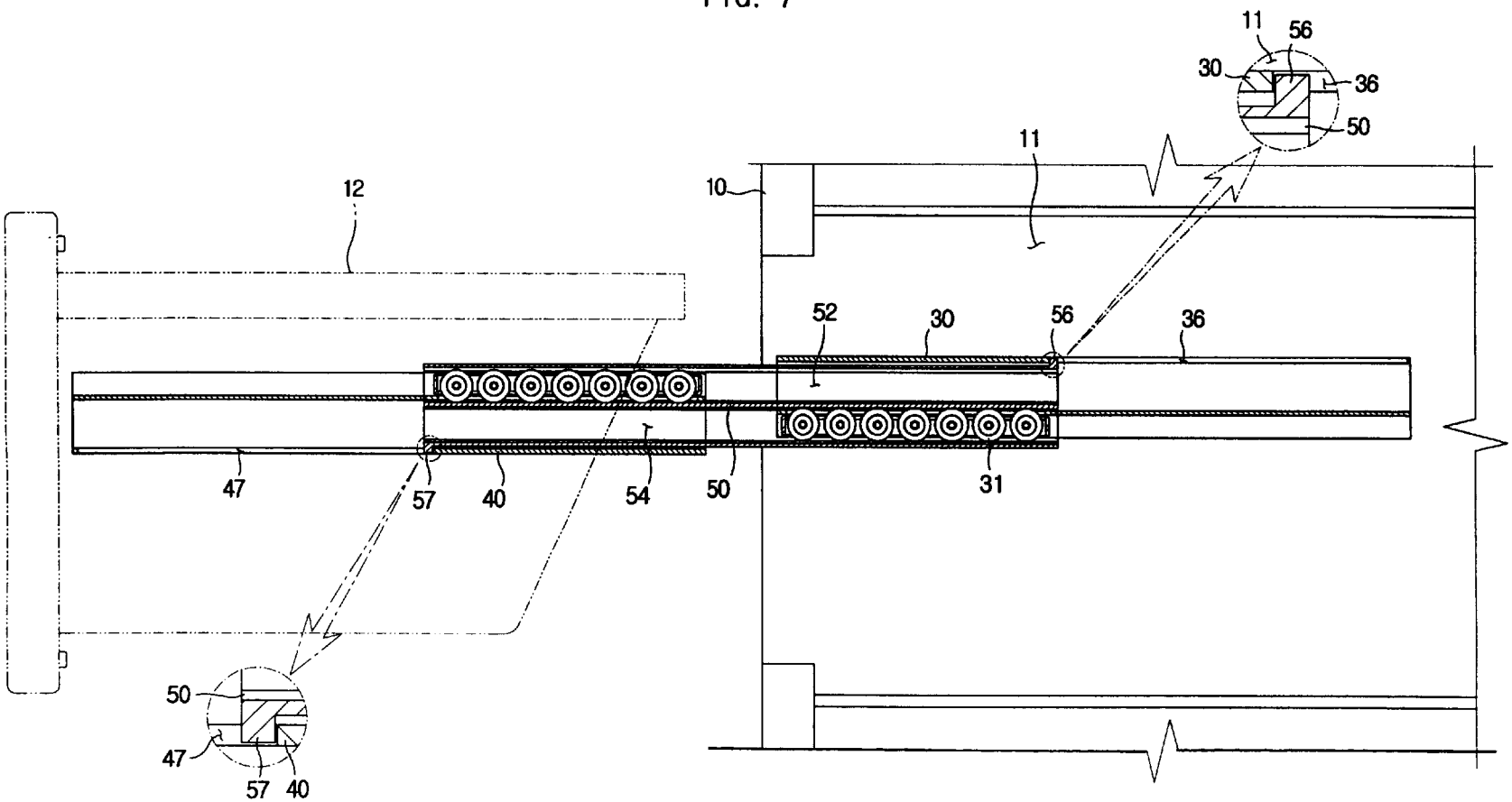
FIG. 7 is a side-sectional view of an embodiment of the sliding device wherein the storage container is in a fully opened position.

As shown in FIG. 7, when the middle rail 50 moves forwardly a predetermined distance corresponding to that at which the storage container 12 is fully opened, the upper hooking member 56 engages the front end of the upper opening 36 of the fixed rail 30, thereby stopping the further movement of the middle rail 50.

If a user pushes the storage container 12 into the storage chamber 11 after putting food into or withdrawing food from the storage container 12, the storage container 12 slides into the storage chamber 11 in an operation which is the reverse of that associated with pulling out the storage container 12.

During the sliding motion of the storage container 12 described above, the weight of the storage container 12 is transferred to the partition rail portion 55 of the middle rail 50 through the second rollers 41 of the movable rail 40, and thereafter to the first rollers 31 of the fixed rail 30. Finally, the weight of the container 12 is transferred to a side wall of the storage chamber 11 on which the fixed rail 30 is mounted.

It will be understood from the foregoing that during the sliding motion of the sliding device 20, the first and second rollers 31 and 41 contact and roll on the partition rail portion 55 of the middle rail 50. Further, the weight of the storage container 12 is transferred proportionally to the first and second rollers 31 and 41. This operation provides smoothing out of the sliding motion of the middle rail 50 and the movable rail 40 (see FIG. 4).

Alternatively, the movable rail 40 and the middle rail 50 may be moved in reverse order or simultaneously. However, the fundamental operation of the respective rails 40 and 50 remains the same.

Because the fixed rail 30, the movable rail 40, the middle rail 50 and the plural rollers 31 and 41 are made of an injection molded plastic, the sliding device 20 does not rust nor is device 20 prone to other problems associated with metal parts in a humid environment. Therefore, the device 20 can be used in the humid storage chamber 11 of a refrigerator or the like without impairing the operation of the sliding device 20. Further, because the first and second rollers 31 and 41 roll with minimum contact in the guiding grooves 55*a* and 55*b* formed in the partition rail portion 55, the rollers 31 and 41 can roll over granular ice which may be produced on a surface of the middle rail 50, thereby ensuring smooth movement of the storage container 12.

Although the invention has been described above in relation to preferred embodiments thereof, it will be understood by those skilled in the art that variations and modifications can be effected in these preferred embodiments without departing from the scope and spirit of the invention.

What is claimed is:

1. A sliding device for providing sliding backward and forward movement of a drawer-type storage container relative to a storage case, the storage container being slidably mounted inside the storage case, and said sliding device comprising:

a first plurality of roller;

a second plurality of rollers;

a fixed rail fixedly mounted to an inner side surface of the storage case and including a roller coupling portion rollably receiving said first plurality of rollers;

a movable raid fixedly mounted to an outer side surface of the storage container and including a roller coupling portion rollably receiving said second plurality of rollers; and a middle rail slidably mounted between the fixed rail and the movable rail for providing a coupling relationship therebetween and for guiding the rolling motion of the first and second plurality of rollers such that the movable rail and the storage container slide together by means of a rolling motion of the second plurality of rollers along the middle rail, and the middle rail slides along the fixed rail by means of a rolling motion of the first plurality of rollers, the middle rail further comprising:

an upper rail portion including an upper channel for receiving the roller coupling portion of the movable rail therein and for guiding the sliding motion of the movable rail;

a lower rail portion including a lower channel for receiving the roller coupling portion of the fixed rail therein and for guiding the sliding motion of the middle rail, a partition rail portion integrally connecting the upper rail portion and the lower rail portion while partitioning the upper channel from the lower channel, and the fixed rail includes a guiding space for receiving the upper rail portion and the movable rail includes a guiding space for receiving the lower rail portion.

2. A sliding device according to claim 1, wherein the upper rail portion of the middle rail opens toward the roller coupling portion of the movable rail, and wherein the lower rail portion of the middle rail opens toward the roller coupling portion of the fixed rail.

3. A sliding device according to claim 1, further comprising first movement restricting means located between the fixed rail and the middle rail for restricting the movement of the middle rail, and second movement restriction means located between the middle rail and the movable rail for restricting the movement of the movable rail.

4. A sliding device according to claim 3, wherein the first and second movement restricting means each include hooking members and respective openings for receiving the hooking members therein.

5. A sliding device according to claim 4, wherein the hooking members protrude upwardly from the upper end surface of the middle rail and downwardly from the lower end surface of the middle rail, and wherein the openings extend longitudinally of the fixed rail and at the movable rail, respectively.

6. A sliding device according to claim 1, further comprising: a plurality of slots formed in the roller coupling portions of the fixed rail and movable rail, respectively, such that the first plurality of rollers and the second plurality of rollers extend through the slots and undergo rolling motion in contact with the corresponding partition rail portion.

7. A sliding device according to claim 6, wherein said partition rail portion includes longitudinally extending guiding grooves for guiding the rolling motion of the first and second plurality of rollers.

8. A sliding device according to claim 1, further comprising a first roller supporting member within which the first plurality of rollers are disposed in series and a second roller supporting member within which the second plurality of rollers are disposed in series, the first roller supporting member being disposed in the roller coupling portion of the fixed rail and the second roller supporting member being disposed in the roller coupling portion of the movable rail.

9. A sliding device according to claim 1, wherein the movable rail is comprised of an injection molded plastic, the fixed rail is comprised of an injection molded plastic, the middle rail is comprised of an injection molded plastic, and the rollers are comprised of an injection molded plastic.

* * * * *